US009355578B2

(12) United States Patent
El-Afandi et al.

(10) Patent No.: US 9,355,578 B2
(45) Date of Patent: May 31, 2016

(54) CONTAINER LABEL AND RELATED METHODS

(71) Applicant: GENERAL MILLS, INC., Minneapolis, MN (US)

(72) Inventors: Ali El-Afandi, Maplewood, MN (US); Jeremy R. Marincel, Rockford, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 14/155,985

(22) Filed: Jan. 15, 2014

(65) Prior Publication Data

US 2014/0202642 A1 Jul. 24, 2014

Related U.S. Application Data

(60) Provisional application No. 61/754,147, filed on Jan. 18, 2013.

(51) Int. Cl.
*G09G 3/04* (2006.01)
*G09F 3/00* (2006.01)
(Continued)

(52) U.S. Cl.
CPC ..... *G09F 3/0295* (2013.01); *G09F 3/0288* (2013.01); *G09F 3/10* (2013.01); *G09F 2003/0205* (2013.01);
(Continued)

(58) Field of Classification Search
CPC ..... G09F 3/04; G09F 1/04; G09F 3/10; G09F 3/0288; G09F 23/00; G09F 3/0289; B65D 23/14; B65D 25/205; B65D 81/03; B65D 5/5007; B65D 65/403; B65D 75/68; B65D 75/5833; B31D 5/006; B31F 1/26
See application file for complete search history.

(56) References Cited

U.S. PATENT DOCUMENTS 814,592 A 3/1906 Duane
RE14,000 E 10/1915 Cole
(Continued)

FOREIGN PATENT DOCUMENTS

EP 690000 A2 1/1996
EP 690000 B1 4/1999
(Continued)

OTHER PUBLICATIONS

"Peel N Reveal", Brochure from Multi-Color Corporation, <http://www.mcclabel.com/documents/MCC_PeelNReveal_000.pdf>, accessed from the Internet on Dec. 10, 2012.
(Continued)

*Primary Examiner* — Cassandra Davis
(74) *Attorney, Agent, or Firm* — Ashley N. Nicholls; Susanne T. Jones; Annette M. Frawley

(57) ABSTRACT

A label for a container may include a planar body comprising a first edge and a second edge, the first and second edges disposed at opposite sides of the body from each other; a cut-out portion of the planar body disposed between the first and second edges; and first and second tear lines extending from the cutout portion to respective first and second termination locations at or proximate to the first and second edges, respectively. The first and second tear lines may diverge at an angle away from each other in a direction from the cut-out portion to the respective first and second termination locations.

18 Claims, 8 Drawing Sheets

(51) Int. Cl.

| | |
|---|---|
| ***G09F 3/10*** | (2006.01) |
| *G09F 23/00* | (2006.01) |
| *G09F 3/02* | (2006.01) |

(52) U.S. Cl.

CPC ..... *G09F 2003/0213* (2013.01); *G09F 2003/0222* (2013.01); *G09F 2003/0251* (2013.01); *G09F 2003/0269* (2013.01); *G09F 2003/0272* (2013.01); *G09F 2023/0025* (2013.01); *Y10T 156/1168* (2015.01); *Y10T 156/1184* (2015.01); *Y10T 428/15* (2015.01)

(56) References Cited

U.S. PATENT DOCUMENTS

| | | | | | |
|---|---|---|---|---|---|
| 1,273,105 | A | | 7/1918 | Van Dyke | |
| 1,756,944 | A | * | 5/1930 | Gorton, Jr. | 40/306 |
| 2,252,463 | A | * | 8/1941 | Jackley | 15/431 |
| 2,732,063 | A | * | 1/1956 | Dedek et al. | 206/410 |
| 2,775,394 | A | * | 12/1956 | Lucas, Jr. | 229/201 |
| 2,780,379 | A | * | 2/1957 | Ferguson | B21D 51/383 215/256 |
| 2,962,302 | A | | 11/1960 | Layton | |
| 3,522,907 | A | * | 8/1970 | Utterback, Jr. | 206/309 |
| 3,994,089 | A | | 11/1976 | Schwartz | |
| 4,004,705 | A | * | 1/1977 | Fujio | B65D 55/0854 215/246 |
| 4,170,305 | A | * | 10/1979 | Hull et al. | 229/87.05 |
| 4,470,511 | A | * | 9/1984 | Meeker et al. | 229/313 |
| 5,208,445 | A | | 5/1993 | Nahar et al. | |
| 5,240,755 | A | | 8/1993 | Zimmer | |
| 5,342,093 | A | | 8/1994 | Weernink | |
| 5,474,183 | A | | 12/1995 | Warren et al. | |
| 5,482,205 | A | * | 1/1996 | Drummond et al. | 229/201 |
| 5,484,167 | A | | 1/1996 | Donaldson et al. | |
| 5,547,451 | A | | 8/1996 | Drummond et al. | |
| 5,780,133 | A | | 7/1998 | Engstrom | |
| 5,924,739 | A | * | 7/1999 | Garbutt | G09F 3/10 156/DIG. 13 |
| 6,047,488 | A | | 4/2000 | Tuszkiewicz | |
| 6,089,483 | A | | 7/2000 | St-Laurent | |
| 6,321,473 | B1 | | 11/2001 | Klabunde | |
| 6,382,676 | B1 | | 5/2002 | Cochran et al. | |
| 6,604,307 | B1 | * | 8/2003 | Cahill et al. | 40/306 |
| 6,908,113 | B2 | | 6/2005 | Chaduc et al. | |
| 7,448,153 | B2 | | 11/2008 | Maliner et al. | |
| 7,601,410 | B2 | | 10/2009 | Matthews et al. | |
| 2001/0011677 | A1 | | 8/2001 | Falat et al. | |
| 2003/0047937 | A1 | | 3/2003 | Chaduc et al. | |
| 2003/0230380 | A1 | | 12/2003 | Greenhill et al. | |
| 2004/0250947 | A1 | | 12/2004 | Phillips et al. | |
| 2005/0275213 | A1 | | 12/2005 | Whitehouse et al. | |
| 2007/0128395 | A1 | | 6/2007 | Gonzales | |
| 2008/0269036 | A1 | | 10/2008 | George | |
| 2008/0314862 | A1 | | 12/2008 | Matsuoka et al. | |
| 2009/0136701 | A1 | * | 5/2009 | Speeney | G09F 3/02 428/43 |
| 2010/0314390 | A1 | * | 12/2010 | D'Angelico | B65D 51/248 220/254.1 |

FOREIGN PATENT DOCUMENTS

| | | | | |
|---|---|---|---|---|
| JP | 2011207502 | A | * | 10/2011 |
| WO | WO92-18077 | A1 | | 10/1992 |
| WO | WO2004-114255 | A2 | | 12/2004 |

OTHER PUBLICATIONS

Ali El-Afandi et al. "Label," Design U.S. Appl. No. 29/443,543, filed Jan. 18, 2013.

Ali El-Afandi et al. "Label on Container," Design U.S. Appl. No. 29/443,545, filed Jan. 18, 2013.

* cited by examiner

CONTAINER LABEL AND RELATED METHODS

CROSS-REFERENCE TO RELATED APPLICATIONS

This application claims the benefit of priority under 35 U.S.C. §119(e) to U.S. Provisional Application No. 61/754,147 (filed on Jan. 18, 2013), entitled "CONTAINER LABEL AND RELATED METHODS," the entire content of which is incorporated by reference herein. This application is related to Design patent application No. 29/443,545 (filed Jan. 18, 2013), entitled "LABEL;" and U.S. Design patent application No. 29/443,543 (filed Jan. 18, 2013), entitled "LABEL ON CONTAINER," the entire contents of each of which are incorporated by reference herein.

TECHNICAL FIELD

The present disclosure relates generally to container labels, and methods for removing such labels from containers. More particularly, the present disclosure relates to removable container labels that can be removed by a consumer after purchase of a product and that display useful content to the consumer, such as, for example, on the back of the label.

BACKGROUND

The section headings used herein are for organizational purposes only and are not to be construed as limiting the subject matter described in any way.

To enhance the appeal and marketability of a product beyond the product itself, manufacturers often include a premium and/or promotion with the product. In some cases, it is desirable for premiums or promotions to generally be relatively inexpensive to manufacture and easily included with the product without disruption of the normal handling of the product during manufacturing, distribution and/or by the consumer. For example, promotional devices that are easily includable with the product may not require different kinds of packaging or the like, which could, for example, increase the cost of product production. Similarly, it may be desirable for the promotional device to not require special handling or care by the manufacturer and retailer beyond that normally given the product without the promotional device.

As an example, coupons, which can be immediately redeemed to purchase the product, have been included with products as a promotional device. Such coupons are often provided as a part of the product packaging, for example, as part of the product's label. The coupon can be removed from other portions of the packaging (e.g., label) for redemption by a consumer. Although promotional devices that are placed with products, such as coupons or the like have experienced considerable market success, there is a continued need to present new and improved promotional devices to refresh products and enhance their marketability. Furthermore, for some promotional devices that are included as a removable portion of the product label, only a small portion of the label may be removed, while maintaining the integrity and aesthetics of the remaining portions of the label on the container. Therefore, such promotional devices have a limited amount of display space allotted which corresponds to the removable portion of the overall label.

Thus, a continued need exists for new and varied product promotional devices, and in particular for promotional devices that are provided as part of a product's packaging (e.g., label). It may therefore be desirable to provide a container label that does not require special handling or care by the manufacturer and retailer, but is easily removed by a consumer upon purchase of the product and/or that provides a relatively larger amount of display space.

SUMMARY

The present disclosure may solve one or more of the above-mentioned problems and/or achieve one or more of the above-mentioned desirable features. Other features and/or advantages may become apparent from the description which follows.

In accordance with an exemplary embodiment of the present disclosure, a label for a container may include a planar body comprising a first edge and a second edge, the first and second edges disposed at opposite sides of the body from each other; a cut-out portion of the planar body disposed between the first and second edges; and first and second tear lines extending from the cutout portion to respective first and second termination locations at or proximate to the first and second edges, respectively. The first and second tear lines may diverge at an angle away from each other in a direction from the cut-out portion to the respective first and second termination locations.

In accordance with another exemplary embodiment of the present disclosure, a method for removing a label attached to a container can include tearing a first portion of the label away from the container along first and second tear lines and in a direction generally perpendicular to a longitudinal axis of the container, wherein the tear lines extend diagonally away from each other from a location of the label between first and second opposite edges of the label and toward the respective opposite edges of the label. The method may further include, after tearing along the tear lines, releasing an adhesive affixing the label to the container to remove a remaining portion of the label from the container, wherein the remaining portion is attached to the first portion.

Additional objects and advantages will be set forth in part in the description which follows, and in part will be obvious from the description, or may be learned by practice of the present disclosure. At least some of the objects and advantages of the present disclosure may be realized and attained by means of the elements and combinations particularly pointed out in the appended claims.

It is to be understood that both the foregoing general description and the following detailed description are exemplary and explanatory only and are not restrictive of the invention, as claimed. It should be understood that the invention, in its broadest sense, could be practiced without having one or more features of these exemplary aspects and embodiments.

BRIEF DESCRIPTION OF DRAWINGS

The accompanying drawings, which are incorporated in and constitute a part of this specification, illustrate some exemplary embodiments of the present disclosure and together with the description, serve to explain certain principles. In the drawings.

DESCRIPTION OF EXEMPLARY EMBODIMENTS

Figure 1:
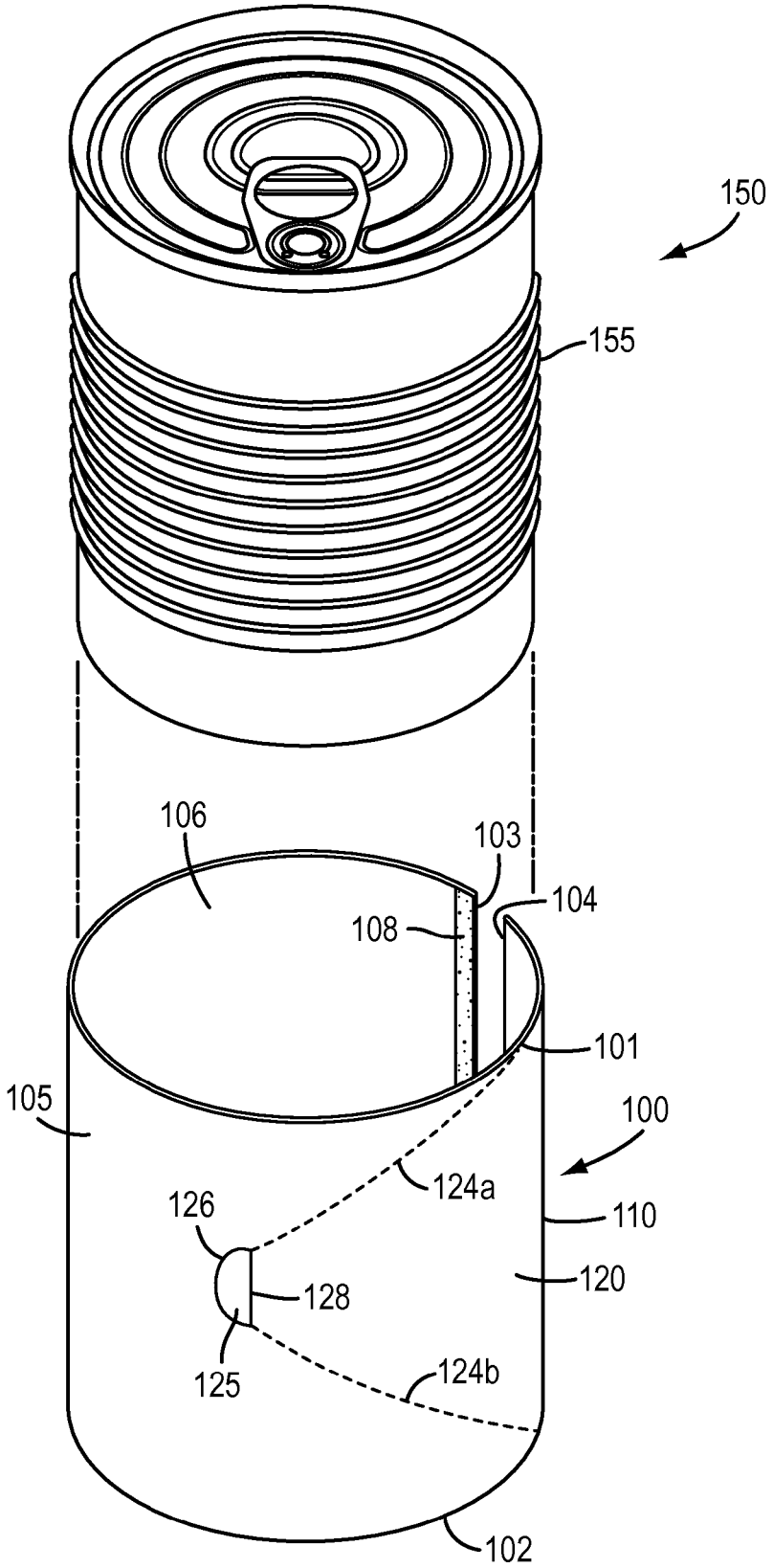
FIG. 1 is an exploded perspective view of an exemplary embodiment of a container and label in accordance with the present disclosure.

Reference will now be made in detail to various exemplary embodiments of the present disclosure, examples of which are illustrated in the accompanying drawings. Wherever possible, the same reference numbers will be used throughout the drawings to refer to the same or like parts.

To enhance the appeal and marketability of a product beyond the product itself, manufacturers often include a premium and/or promotion with the product. Although labeling concepts that incorporate such premiums or promotions within the label have experienced considerable market success, there is a continued need to present new and improved premiums and promotions to refresh products and enhance their marketability. As used herein, premiums, promotions, or variations thereof may include any type of marketing tool and/or inducement that is presented to a consumer to purchase a product. Various types of premiums and promotions contemplated herein include but are not limited to, for example, coupons, recipes, contests, entertainment content, product information, or various other content.

To further enhance the appeal and marketability of products packaged in containers, various exemplary embodiments of the present disclosure provide a label for a container, such as, for example, a cylindrical container such as an aluminum can, wherein the label provides a large display space for product, promotional and/or premium content. In various embodiments, for example, the label may be easily removed from the container, for example, by pulling a portion of the label in a direction generally perpendicular to a longitudinal axis of the container. In various additional embodiments, the label can contain product, promotional and/or premium content on a surface of the label that faces the container when the label is attached to the container (e.g., a back surface of the label) that is useful to a consumer, for example, after purchasing the product.

In various exemplary embodiments, a label for a container may comprise a planar body comprising first and second tear lines extending from a cut-out portion to respective first and second termination locations at or proximate to first and second edges of the body. Thus, in various embodiments, the first and second tear lines are angled or sloping lines (i.e., diagonal lines) that extend from the cut-out portion to respective first and second termination locations, such that the tear lines diverge at an angle away from each other in a direction from the cut-out portion to the respective first and second termination locations. In at least one exemplary embodiment, when the label is attached to a container, the entire planar body of the label may be removed from the container by tearing the label along the first and second tear lines in a direction generally perpendicular to a longitudinal axis of the container and toward respective termination locations of the first and second tear lines. Thus, in various embodiments, a surface of the label that faces the container when the label is attached to the container may comprise printed content, such as, for example, product, promotional and/or premium content. The label may be removed from the container (e.g., after purchase by a consumer) to display such content.

Figure 2:
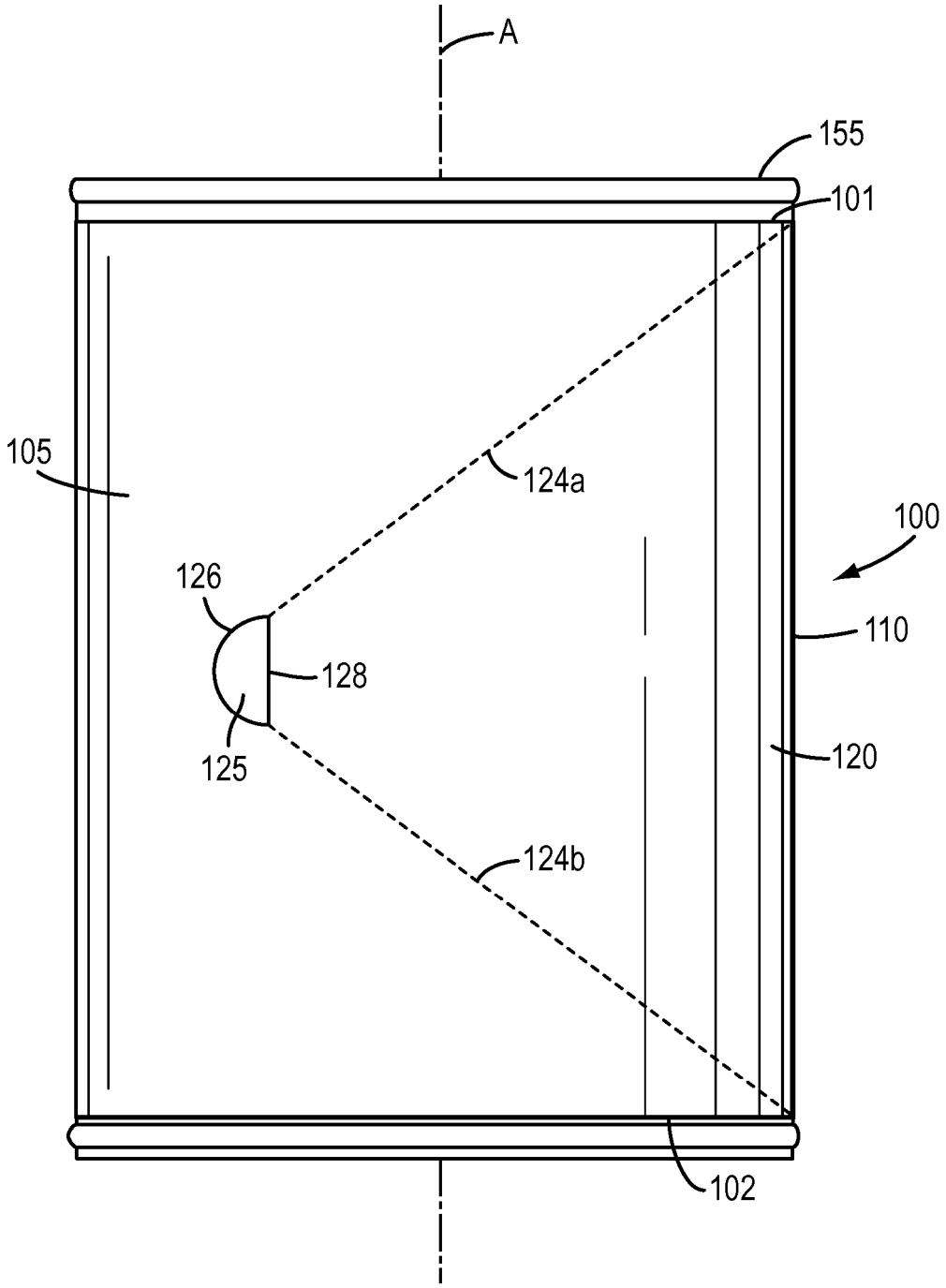
FIG. 2 is a side view of the container and label of FIG. 1.
Figure 8:
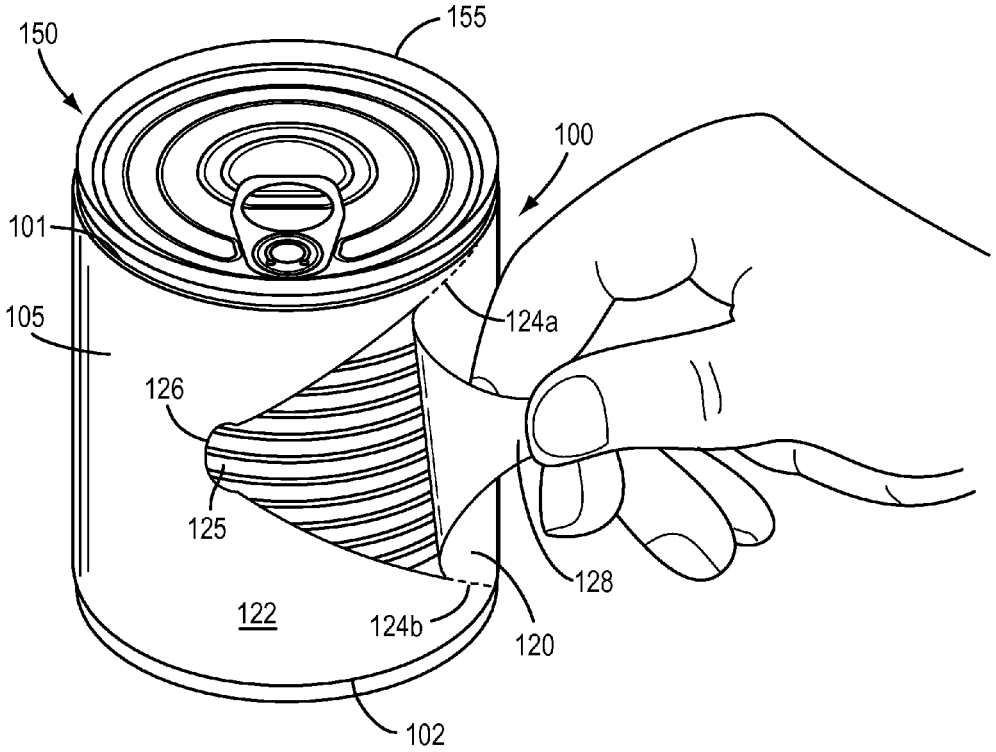
FIG. 8 is a perspective view of the label of FIG. 1 being removed from the container of FIG. 1 in accordance with the present disclosure.

FIGS. 1-6 and 8 illustrate an exemplary label in accordance with the present disclosure. Product information and other related content is not shown on the label for simplicity of illustration, but it should be understood that the label may depict a variety of content related to the item to which it is affixed. A label 100 may include a planar body 110, for example, of flexible, sheet-like material that is adapted for attachment to a container 150. As illustrated in FIGS. 1, 2, and 8, the container 150 may comprise a cylindrical container, such as, for example, a can 155, and the planar body 110 may be adapted for attachment to the can 155. Those of ordinary skill in the art would understand, however, that the can 155 illustrated in FIGS. 1 and 2 is exemplary only, and that labels in accordance with the present disclosure may be adapted for use with (and attachment to) containers having various configurations, shapes, dimensions, and/or volumes based on the type of product intended to be packaged therein. In various additional embodiments, for example, the container 150 may comprise a bottle, carton, box and/or other structure suitable for packaging a consumer product, and the planar body 110 may be adapted (e.g., sized, shaped, and/or configured) for attachment to such container.

Furthermore, those of ordinary skill in the art would understand that labels in accordance with the present disclosure may be adapted for use with (and attachment to) containers formed from various materials, including, but not limited to, various metals (e.g., aluminum) and plastics.

In various embodiments, the planar body 110 comprises first and second edges that are disposed opposite to each other. In various additional embodiments, the planar body 110 comprises first and second opposite ends that extend between the first and second edges. As best shown perhaps in FIGS. 1, 3, and 4, for example, prior to removal from the can 155, in various embodiments, the planar body 110 may generally comprise a rectangular shape having a first edge 101, a second edge 102, a first end 103, a second end 104, a surface 105 intended to face away from the container upon application thereto, and a surface 106 intended to face the container upon application thereto. The label 100 may be attached to the can 155 using any conventional packaging methods, techniques, and/or machinery known to those of ordinary skill in the art. In various embodiments, for example, the planar body 110 may have a height H (see FIG. 3) that is generally equal to but slightly less than a height of the can 155, and a length L (see FIG. 3) that is generally equal to but slightly greater than a circumference of the can 155.

As illustrated in FIG. 1, the label 100 may therefore be wrapped around the can 155 (e.g., via rotation of the can 155 about a longitudinal axis A of the can 155) to cover the entire outer circumference of the can 155. In various embodiments, for example, when the label 100 is wrapped around the can 155, the first and second ends 103 and 104 of the planar body 110 meet and overlap along respective portions 108 and 109 (see FIGS. 1, 3, and 4). In this manner, an adhesive, such as, for example, a glue, may be applied to one and/or both of the portions 108 and 109 to effectively glue the overlapping surfaces of the label together and attach the label to the can. To further secure the label 100 to the can 155, in various embodiments, an additional amount of adhesive may be applied to the surface 106 of the planar body 110 within a region of overlap generally designated as region 134 (see FIG. 6).

Thus, in various embodiments, the planar body 110 may be formed from a flexible, sheet-like material that is pliable enough to be wrapped around and attached to the can 155, while still being strong enough to prevent premature tearing of the label during manufacture, application to a container, and distribution. In various embodiments, for example, the planar body 110 may be made from a paper material with a weight of about 50 pounds to about 80 pounds. In various additional embodiments, the planar body 110 may be made from a paper material with a glossy protective coating, such as, for example, a low-density polyethylene (LDPE) coating on a portion of at least one surface of the paper, such as, for example, surface 105 and/or surface 106. Those of ordinary skill in the art would understand, however, that labels in accordance with the present disclosure may be made of various materials that are suitable for labeling applications, including, but not limited to, various papers, plastics, foils, and/or laminates.

As would be further understood by those of ordinary skill in the art, the label 100 illustrated in FIGS. 1-6 and 8 is exemplary only and the planar body 110 of the label 100 may have various shapes, dimensions, and/or configurations depending on the shape and/or dimensions of the container 150 to which the label is intended to be applied. In various embodiments, for example, for a can with a height of about 4 7/16 (4.4375) inches and a diameter of about 3 7/16 (3.4375) inches, the body 110 may have a height H of about 3 15/16 (3.9375) inches and a length L of about 10 7/8 (10.875) inches. In various additional embodiments, for a can with a height ranging from about 3 6/16 (3.375) inches to about 6 inches and a diameter ranging from about 2 1/8 (2.125) inches to about 6 3/16 (6.1875) inches, the body 110 may have a height ranging from about 2 1/4 (2.25) inches to about 6.5 inches and a length L ranging from about 7.5 inches to about 16 inches. It is, therefore, within the ability of one ordinarily skill in the art to determine the desired dimensions, shape, and/or configuration of the planar body 110 based upon a given container and labeling application.

In order to permit the label 100 to be removed from the can 155, the planar body 110 comprises a first portion 120 that is defined by first and second tear lines 124*a* and 124*b*. As illustrated in FIGS. 1-4, the first and second tear lines 124*a* and 124*b* each originate at a central region on the planar body 110 and respectively terminate at a location at or proximate to the first and second edges 101 and 102 of the planar body 110. Thus, as best shown perhaps in FIGS. 3 and 4, the planar body comprises two portions, the first portion 120 (which is intended to be torn away from the can 155) and a second portion 122 from which the first portion 120 is detached when torn along the tear lines 124*a* and 124*b*.

In various exemplary embodiments, the tear lines 124*a* and 124*b* extend from a cut-out portion 125 of the planar body 110 that is disposed between the first and second edges 101, 102. In various embodiments, for example, the tear lines 124*a* and 124*b* extend from the cut-out portion 125 to respective termination locations 127*a* and 127*b* at or proximate to the first and second edges 101, 102 at an angle θ of about 30 degrees to about 45 degrees, where θ is measured from the imaginary line where the tear lines 124*a*, 124*b* would intersect. In other words, the first and second tear lines 124*a* and 124*b* diverge at an angle θ away from each other in a direction from the cut-out portion 125 to the respective first and second termination locations 127*a* and 127*b*, such that the tear lines 124*a*, 124*b* define an internal angle between them ranging from about 60 degrees to about 90 degrees.

As also illustrated in FIGS. 1-4, in various embodiments, the cut-out portion 125 is disposed substantially midway along the height H of the planar body 110 at a distance $D_G$ from the second end 104 of the body 110. The cut-out portion 125 being a space or hole that is formed in the planar body 110 that is configured (e.g., shaped and sized) to allow insertion of a fingernail or fingertip. In various embodiments, for example, as illustrated in FIGS. 1-4, the cut-out portion may have a semi-circular shape defined by a curved portion 126 and a straight portion 128, with a radius R (see FIG. 3), for example, ranging from about 0.25 inches to about 0.75 inches.

As would be understood by those of ordinary skill in the art, the first portion 120 (as defined by the tear lines 124*a* and 124*b*) and cut-out portion 125 illustrated in FIGS. 1-4 are exemplary only and may have various shapes, dimensions, and/or configurations, for example, depending on the shape and/or dimensions of the label 100 and the angle θ at which the tear lines 124*a* and 124*b* extend across the planar body 110. In the same manner, the tear lines 124*a* and 124*b* may also follow various paths and extend at various angles θ from the cut-out portion 125. Furthermore, the cut-out portion 125 may be positioned at various locations along the planar body 110 (e.g., at various heights and at various distances $D_G$ from the second end 104 of the planar body 110). It is within the ability of one ordinarily skilled in the art to determine the desired dimensions, shape, and/or configuration of the first portion 120 and cut-out portion 125, and the angled path of the tear lines 124*a* and 124*b*, based upon a desired labeling application.

In various embodiments, the first portion 120 is releasable from the second portion 122 of the planar body 110 by pulling the first portion 120 away from the planar body 110 at a location of the cut-out portion 125. For example, in various exemplary embodiments, the straight portion 128 of the cut-out portion 125 (where the tear lines 124*a*, 124*b* meet) may be grasped to tear the first portion 120 away from the second portion 122. In an exemplary embodiment, the label 100 may be torn along the first and second tear lines 124*a* and 124*b* in a direction that is generally perpendicular to a longitudinal axis A of the can 155 (see FIG. 2) and toward respective termination locations 127*a* and 127*b* of the first and second tear lines 124*a* and 124*b*. In this manner, when the label 100 is attached to the can 155, the entire planar body 110 is releasable and may be removed from the can 155. Removal can occur by pulling the first portion 120 away from the can 155, and from the second portion 122 of the planar body 110, in a direction that is generally perpendicular to a longitudinal axis A of the can 155 and toward respective termination locations 127*a* and 127*b* of the first and second tear lines 124*a* and 124*b*, as illustrated in FIG. 8.

In other words, to remove the label 100 from the can 155, a consumer may grasp the straight portion 128 of the cut-out portion 125, for example, by inserting a fingernail or fingertip into the cut-out portion 125, and pull the first portion 120 in a direction that is substantially perpendicular to the longitudinal axis A of the can 155, to tear the first portion 120 along the tear lines 124*a* and 124*b*. As best shown perhaps in FIGS. 5 and 6 which illustrate the label 100 after removal from the can 155, when the first portion 120 is pulled away from the can 155, the second portion 122 will also be pulled away from the can 155, since the ends 103 and 104 of the planar body 110 are glued together, thereby affixing the second portion 122 to the first portion 120 at the overlap region 134. For ease of removal, in various embodiments, the cut-out portion 125 may be disposed closer to one end of the planar body 110 than the other. For example, in various embodiments, the cut-out portion 125 may be disposed at a distance $D_G$ from the second end 104 of the planar body 110, such that the glue affixing the label 100 to the can 155 at the overlap region 134 may be easily dislodged when the first portion 120 is pulled. In various additional embodiments, wherein the planar body 110 has a length L of about 10⅞ (10.875) inches, the cutout portion 125 may be disposed at a distance $D_G$ of about 3 inches to about 6 inches from the second end 104 of the planar body 110. In other words, the cutout portion 125 may be disposed at a distance $D_G$ from the second end 104 that is about ½ to about ¼, such as, for example, about ⅓ to about ¼, of the distance L between the ends 103 and 104.

Figure 4:
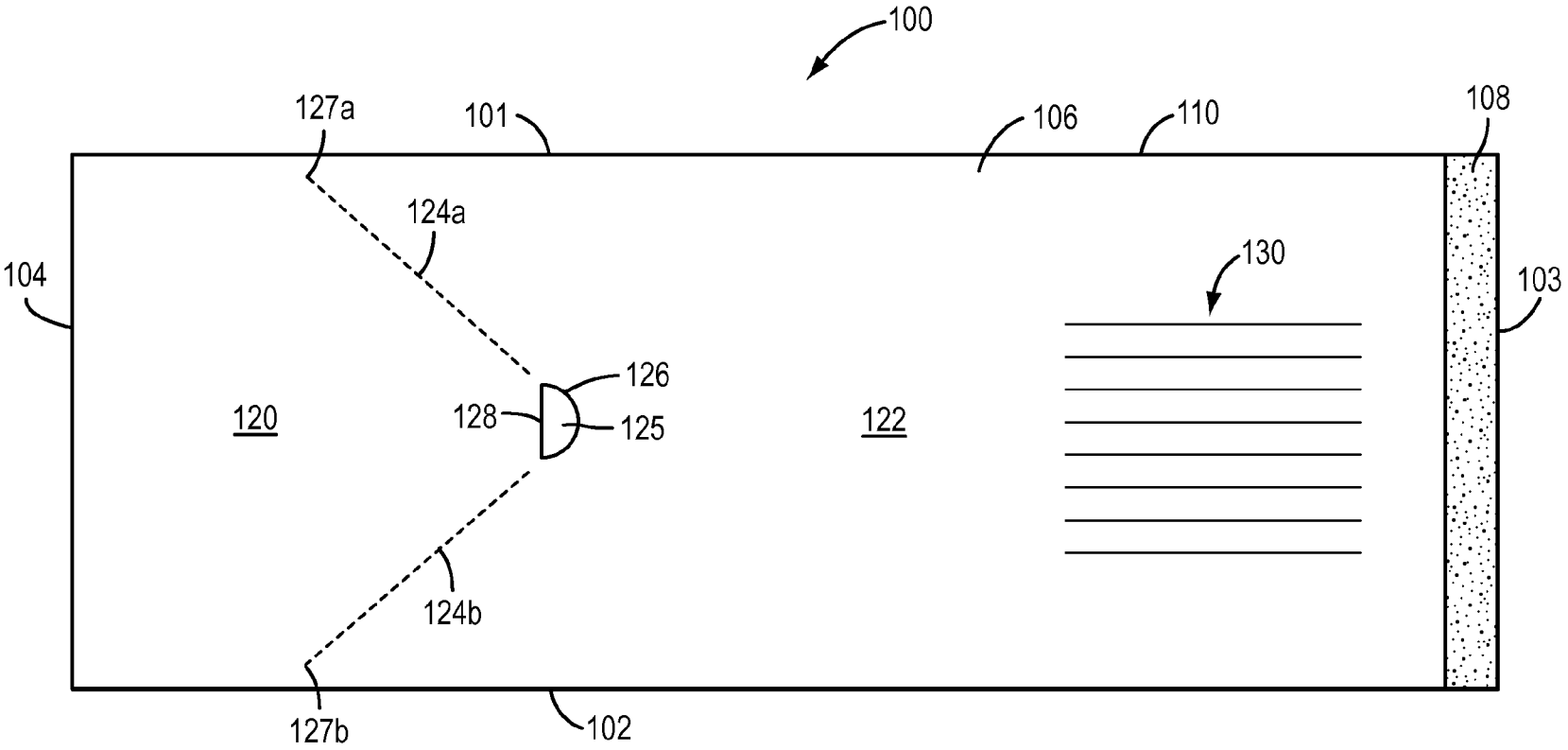
FIG. 4 is a back, plan view of the label of FIG. 1 prior to application to the container of FIG. 1.
Figure 5:
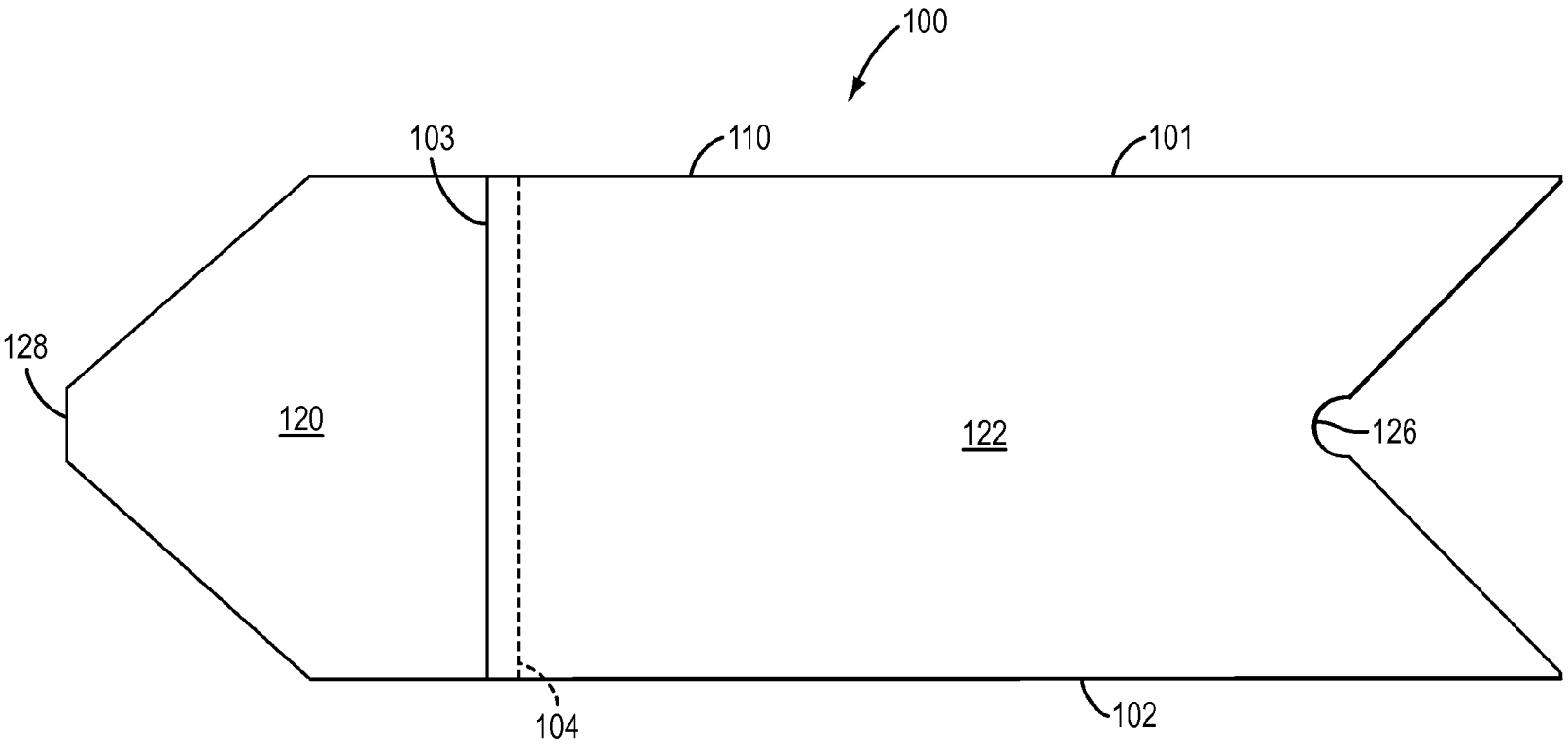
FIG. 5 is a front, plan view of the label of FIG. 1 after removal from the container of FIG. 1.
Figure 6:
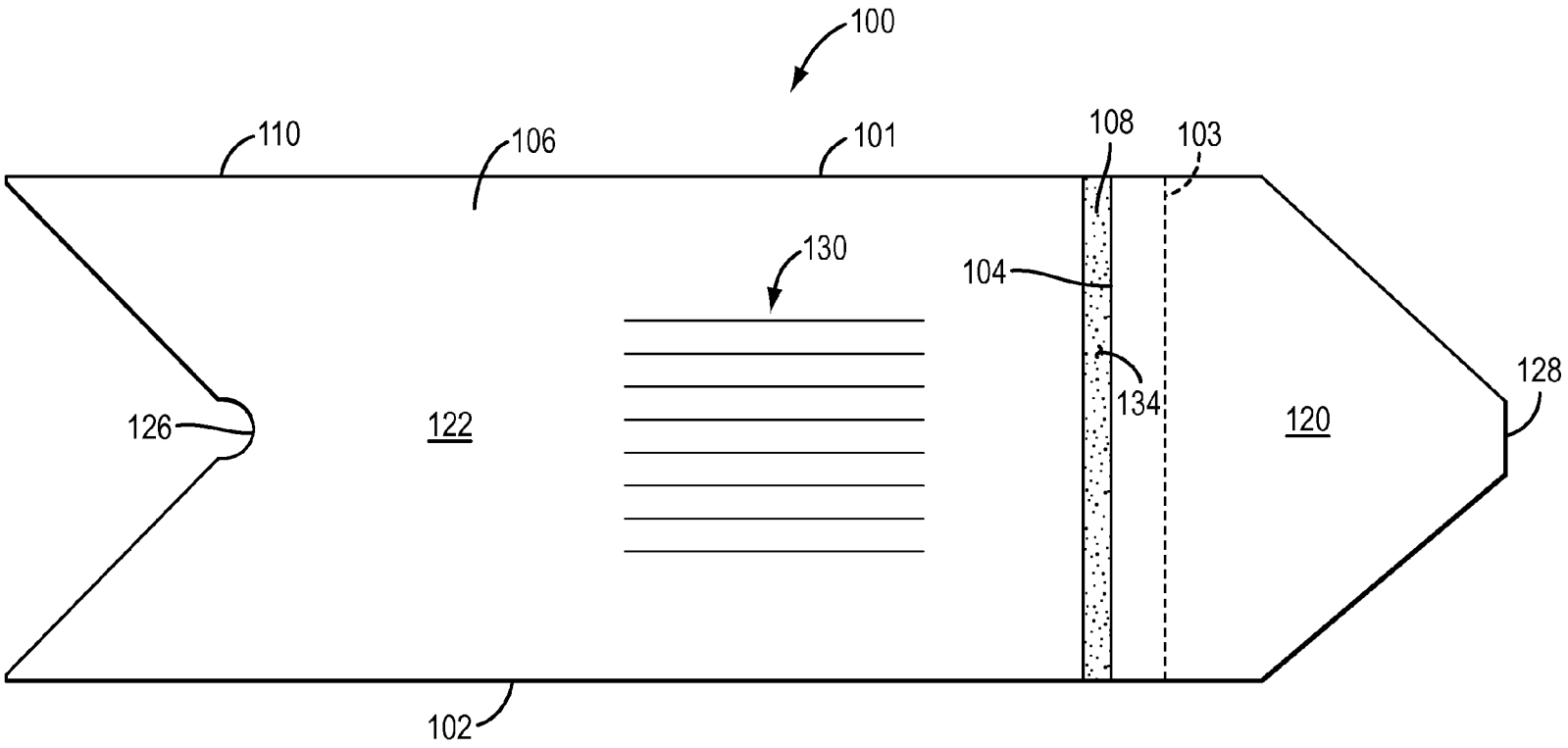
FIG. 6 is a back, plan view of the label of FIG. 1 after removal from the container of FIG. 1.

The label 100 may, therefore, be removed from the can 155 in one piece, as illustrated in FIGS. 5 and 6, to display content 130, such as, for example, product, promotional, and/or premium content, on the surface 106 of the planar body 110. In various embodiments, for example, directions for use, a coupon, and/or other content those having ordinary skill in the art are familiar with, for example, related to the product packaged within the can 155, may be displayed on the surface 106. In one exemplary embodiment, the can 155 may hold a food product, and the content may include a recipe and/or a coupon relating to the food product. To reduce the risk of a portion of the label 100 carrying the content 130 tearing during removal of the label 100, which could impact the ability of a consumer to view the content, in various additional exemplary embodiments, only the surface 106 of the second portion 122 contains the content 130 thereon, as shown in FIGS. 4 and 6.

In various embodiments, the tear lines 124*a* and 124*b* comprise perforations, such as, for example, micro-perforations, having cuts made by blades including equally sized and spaced teeth per inch (TPI). As above, however, the label 100 need not require special handling or care by the manufacturer and retailer to prevent the tear lines 124*a* and 124*b* from prematurely tearing. Accordingly, as would be understood by those of ordinary skill in the art, the perforation cuts (i.e., the TPI of the blades used to cut the perforations) may be chosen to facilitate a user easily tearing the first portion 120 along the tear lines 124*a* and 124*b* to remove the label 100, while also providing perforations that do not prematurely tear during manufacture and distribution of the product. In various embodiments, for example, the perforations are made by blades having about 30 TPI to about 45 TPI.

Figure 3:
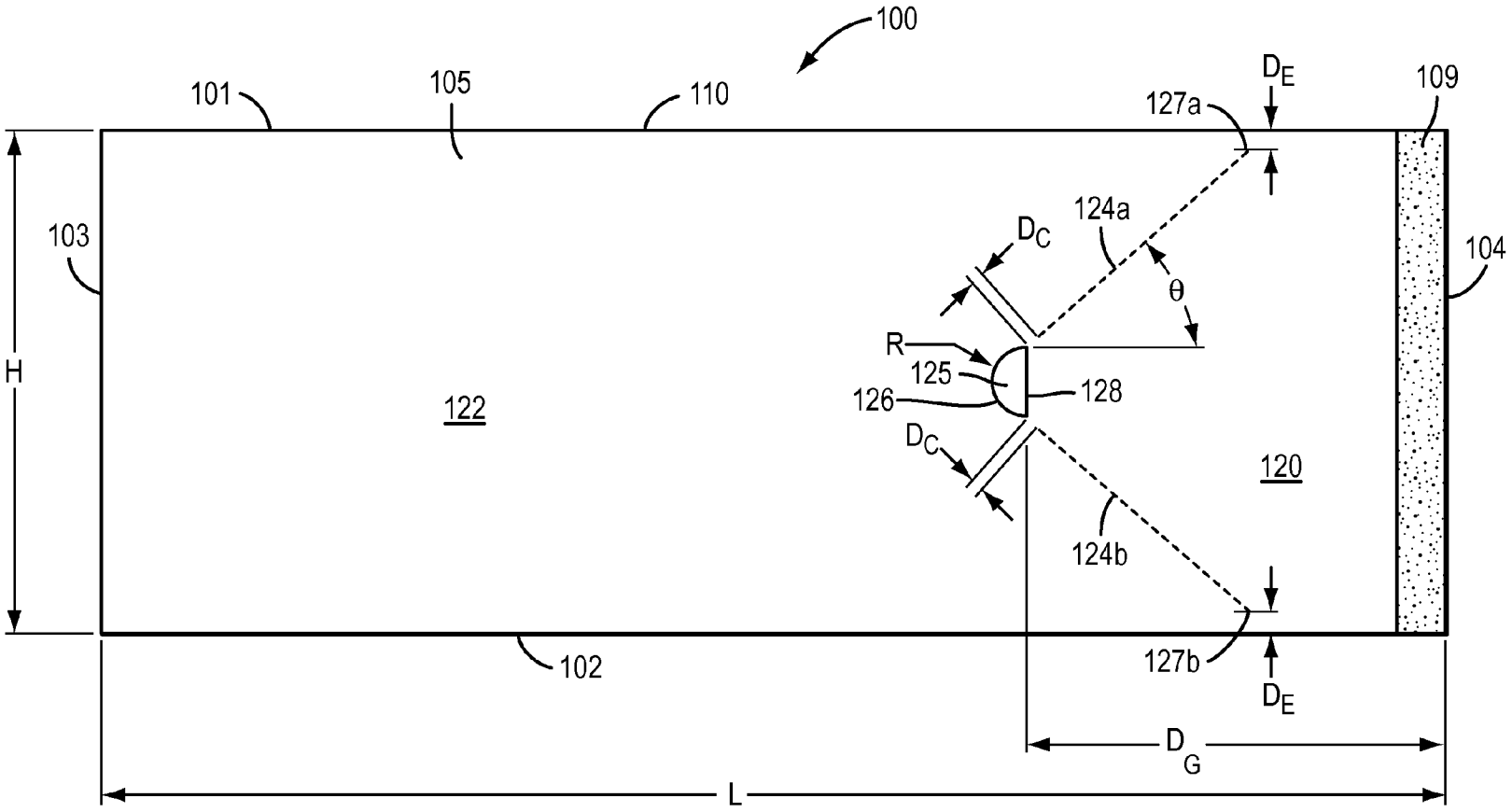
FIG. 3 is a front, plan view of the label of FIG. 1 prior to application to the container of FIG. 1.

To further protect against premature tearing of the tear lines 124*a* and 124*b*, as illustrated in FIG. 3, various embodiments of the present disclosure also contemplate spacing the tear lines 124*a* and 124*b* from the cut-out portion 125 by a distance $D_C$ and from the edges 101, 102 of the planar body 110 by a distance $D_E$. In various embodiments, for example, the tear lines 124*a* and 124*b* may originate at a distance $D_C$ of about 1/32 inch to about 1/16 inch from the cut-out portion 125, and terminate at a distance $D_E$ of about 1/32 inch to about 1/16 inch from the edges 101 and 102.

Figure 7:
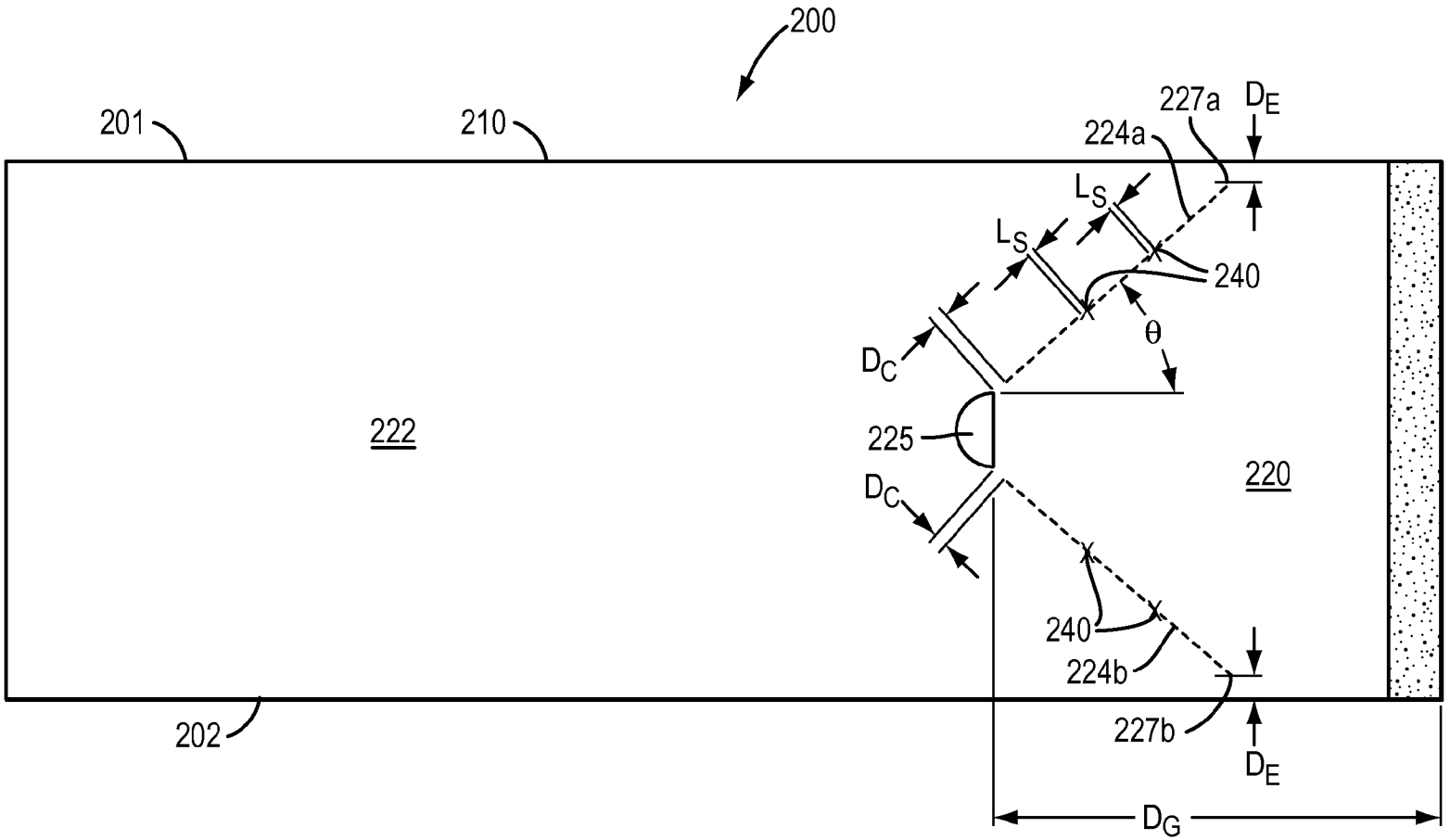
FIG. 7 is a front, plan view of another exemplary embodiment of a label in accordance with the present disclosure prior to application to a container.

Various additional embodiments of the present disclosure contemplate using at least one stay, or uncut region, within the perforations to protect against premature tearing of the tear lines. As illustrated in the embodiment of FIG. 7, for example, a label 200 may comprise a planar body 210 of flexible, sheet-like material including a first portion 220 and a second portion 222. Similar to the embodiment of FIGS. 1-6 and 8, the first portion 220 is defined by first and second tear lines 224*a* and 224*b* extending from a cut-out portion 225 across the body 210 at an angle θ to respective first and second termination locations 227*a* and 227*b* at or proximate to first and second edges 201 and 202. Each tear line 224*a*, 224*b* comprises perforations having two stays 240, each stay (or uncut region) extending a length $L_S$. In various embodiments, for example, each stay 240 may extend a length $L_S$ of about 1/64 inch. Those of ordinary skill in the art would understand, however, that the embodiment of FIG. 7 is exemplary only, and that labels in accordance with the present disclosure may have various numbers of stays, at various positions, and extending various lengths along the perforations of the tear lines, without departing from the scope of the present disclosure and claims.

An exemplary method for removing a label that is attached to a container, such as, for example, a label 100 that is attached to a container 150, in accordance with an exemplary embodiment of the present disclosure is set forth in the following description. As illustrated in FIG. 8, a first portion 120 of the label 100 can be torn away from the container 150 along first and second tear lines 124*a* and 124*b* and in a direction generally perpendicular to a longitudinal axis A of the container 150. As above, the tear lines 124*a* and 124*b* may extend diagonally away from each other from a location of the label 100, such as, for example, a cut-out portion 125, between first and second opposite edges 101 and 102 of the label 100 and toward the respective opposite edges 101, 102 of the label 100. In various embodiments, for example, a fingernail or fingertip can be inserted into the cut-out portion 125 of the label 100 to grasp the first portion 120 to permit the tearing of the first portion 120 along the tear lines 124*a*, 124*b* as illustrated in FIG. 8.

In this manner, after the first portion 120 is torn along the tear lines 124*a* and 124*b*, an adhesive affixing the label 100 to the container 150 can be released to remove a remaining portion (e.g., a second portion 122) of the label 100 from the container 150. In various embodiments, for example, the remaining portion is attached to the first portion 120 and is therefore also removed by the tearing of the first portion 120. Thus, in various exemplary embodiments, the entire label 100 may be removed from the container 150 in a contiguous structure, as illustrated in FIGS. 5 and 6.

In various embodiments, for example, the label 100 can be removed from the container 150, such as, for example, by a consumer after purchasing the product, to display content 130 disposed on a surface 106 of the label 100 facing the container 150 prior to removal from the container 150. In various embodiments, for example, the label 100 can be removed from the container 150 to display content on one or both sides of the label, including, but not limited to, product, promotional, and/or premium content, such as, for example, one or more of factual information, directions for use, recipes, coupons, contests, sweepstakes, ingredient lists, bar codes, quick-recognition codes etc. related to the product packaged within the container 150. In various additional embodiments, when the product packaged within the container 150 is a food product, the content may comprise, for example, an ingredient list on a surface 105 of the label 100 not facing the container (prior to removal from the container 150) and a recipe on the surface 106 of the label 100. However, such content and placement is exemplary only and should not be understood as limiting the scope of the present disclosure and claims.

As would be understood by those of ordinary skill in the art, the exemplary embodiments described herein and illustrated in FIGS. 1-8 are exemplary only and are not intended to limit the scope of the present disclosure and claims. For example, although the embodiments of FIGS. 1-8 show labels having first and second tear lines extending from a cutout portion to respective first and second termination locations at opposite edges of the label, various additional embodiments of the present disclosure further contemplate labels having additional tear lines (not shown). In various embodiments, for example, a label may comprise additional tear lines (in addition to the first and second tear lines 124*a*, 224*a* and 124*b*, 224*b*) to remove a portion of the label from another portion of the label, for example, after the label is removed from a container. In this manner, content located on only a portion of the label, such as, for example, a recipe, may be detached from the remaining portions of the label to be kept for future use by a consumer. Moreover, those having ordinary skill in the art would understand that the exemplary types of content and placement of the content on the labels described herein are exemplary only and various other types and placements can be envisioned based on the present disclosure.

Thus, it is to be understood that the various embodiments shown and described herein are to be taken as exemplary. Elements and materials, and arrangements of those elements and materials, may be substituted for those illustrated and described herein, and portions may be reversed, all as would be apparent to one skilled in the art after having the benefit of the description herein. Changes may be made in the elements described herein without departing from the spirit and scope of the present disclosure and following claims, including their equivalents.

It is to be understood that the particular examples and embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front", "back," "upper," "lower," "side," "end," "edge," and the like, may be used to describe one element's or feature's relationship to another element or feature as intended to connote the orientation of the label for attachment to a container as illustrated in the figures. These spatially relative terms are intended to encompass different positions (i.e., locations) and orientations (i.e., rotational placements) of a label in addition to the position and orientation shown in the figures. For example, if a label in the figures is turned over, elements described as a "first edge" or a "second edge" would then be reversed. A label may also be otherwise oriented (rotated 90 degrees or at other orientations) and the spatially relative descriptors used herein interpreted accordingly.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present disclosure has been described in detail with respect to various exemplary embodiments thereof, it should not be considered limited to such, as numerous modifications are possible without departing from the broad scope of the appended claims, including the equivalents they encompass.

What is claimed is:

1. A label for a container, the label comprising:

a planar body comprising a first edge and a second edge edges, and first and second opposite ends extending between the first and second edges, wherein the first and second edges are disposed at opposite sides of the body from each other and extending extend parallel to each other, wherein a region where the first and second opposite ends overlap comprises an adhesive to secure the label to the container, and wherein the first and second opposite ends are configured to overlap each other in a position of the label secured to the container:

a cut-out portion of the planar body disposed between the first and second edges;

a first tear line extending from the cutout portion to a first termination location at or proximate to the first edge; and a second tear line extending from the cutout portion to a second termination location at or proximate to the second edge;

wherein the first and second tear lines diverge at an angle away from each other in a direction from the cut-out portion to the respective first and second termination locations.

2. The label of claim 1, wherein the label is configured to be removed from a container by tearing the label along the first and second tear lines in a direction generally perpendicular to a longitudinal axis of the container and toward the respective first and second termination locations.

3. The label of claim 1, wherein the cut-out portion and tear lines are disposed closer to one end of the label than the other.

4. The label of claim 3, wherein the cut-out portion is disposed at a position from the one end that is about ⅓ to ¼ of the distance between the ends.

5. The label of claim 1, wherein the label is made of a flexible material.

6. The label of claim 1, wherein the label is made of a paper material with a weight of about 50 pounds to about 80 pounds.

7. The label of claim 1, wherein the first and second tear lines comprise perforations.

8. The label of claim 7, wherein the perforations are made by blades with a teeth per inch (TPI) ranging from about 30 TPI to about 45 TPI.

9. The label of claim 1, wherein each of the first and second tear lines comprises at least one stay disposed along a length of the tear line.

10. The label of claim 9, wherein the at least one stay has a length of about 1/64 inch.

11. The label of claim 1, wherein an angle ranging from about 60 degrees to about 90 degrees is defined between the first and second tear lines.

12. The label of claim 1, wherein the planar body is configured for attachment to a cylindrical container.

13. The label of claim 12, wherein the cylindrical container is an aluminum can.

14. The label of claim 1, wherein the cut-out portion is disposed substantially centrally between the first and second edges.

15. The label of claim 1, wherein the cut-out portion is sized and shaped to allow insertion of a fingernail or fingertip.

16. The label of claim 1, wherein the first and second tear lines originate at a distance of about 1/32 inch to about 1/16 inch from the cut-out portion.

17. The label of claim 16, wherein the first and second termination locations are at a distance of about 1/32 inch to about 1/16 inch from the first and second edges, respectively.

18. The label of claim 1, further comprising product, promotional, and/or premium content disposed on a surface of the planar body that faces the container in a position of the label applied to the container.

* * * * *